US006187388B1

(12) United States Patent
Popoola et al.

(10) Patent No.: US 6,187,388 B1
(45) **Date of Patent: *Feb. 13, 2001**

(54) METHOD OF SIMULTANEOUS CLEANING AND FLUXING OF ALUMINUM CYLINDER BLOCK BORE SURFACES FOR THERMAL SPRAY COATING ADHESION

(75) Inventors: Oludele Olusegun Popoola, Grand Blanc; Matthew John Zaluzec, Canton; Armando Mateo Joaquin, Rochester Hills; Kimberly A. Lazarz, Dearborn, all of MI (US)

(73) Assignee: Ford Global Technologies, Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 26 days.

(21) Appl. No.: 09/130,014

(22) Filed: Aug. 6, 1998

(51) Int. Cl.[7] ..... B05D 3/10; C23C 4/02; C23C 4/08

(52) U.S. Cl. ..... 427/455; 427/456; 427/289; 427/310

(58) Field of Search ..... 427/453, 454, 427/455, 456, 310, 289

(56) References Cited

U.S. PATENT DOCUMENTS

| | | | | |
|---|---|---|---|---|
| 2,785,084 | * | 3/1957 | Lundin | 117/51 |
| 5,723,187 | | 3/1998 | Popoola et al. | 427/453 |
| 5,820,938 | * | 10/1998 | Pank et al. | 427/449 |

FOREIGN PATENT DOCUMENTS

| | | |
|---|---|---|
| 2327092 | 7/1998 | (DE) . |
| 0814173 A2 | 12/1997 | (EP) . |
| 61-073885 | 4/1986 | (JP) . |
| 2205664 | 8/1990 | (JP) . |

* cited by examiner

*Primary Examiner*—Katherine A. Bareford
(74) *Attorney, Agent, or Firm*—Damian Porcari

(57) ABSTRACT

A method of bonding a thermally sprayed coating to a non-roughened light metal surface. The method comprises the steps of (a) depositing a coating surface (i.e. a double potassium aluminum fluoride salt) onto such surface which has been cleaned to be substantially free of grease and oils. The aqueous deposition provides a protective coating layer to inhibit oxide growth; and (b) subsequently thermally spraying metallic droplets or particles onto the protective coating surface to form a metallic coating that is metallurgically bonded to the cast surface.

8 Claims, 5 Drawing Sheets

3% KF 2.5% KF

METHOD OF SIMULTANEOUS CLEANING AND FLUXING OF ALUMINUM CYLINDER BLOCK BORE SURFACES FOR THERMAL SPRAY COATING ADHESION

BACKGROUND OF THE INVENTION

1. Field of the Invention

This invention relates to bonding metallic coatings to aluminum substrates. More particularly, the invention relates to a process for replacing the native aluminum surface oxides with stable coatings to promote a strong metallurgical/chemical bond with sprayed metal coatings.

2. Discussion of the Related Art

Aluminum and aluminum alloys are generally very reactive and rapidly form a passivating surface oxide film (5–100 manometers thick) when exposed to the atmosphere at ambient temperatures. Such oxide film inhibits adherence of metallic coatings to unroughened aluminum. Thus, to effect a metallurgical, chemical or intermetallic bond between the aluminum or aluminum alloy and other metals, it is often necessary to remove, dissolve or disrupt such oxide film. When so stripped of the oxide, aluminum or an aluminum alloy will readily bond with nickel, copper and iron based alloys at temperatures as low at 500° C. Aluminum chemical etchants such as those described in U.S. Pat. No. 3,779,839, typically contain alkali metal fluorides, sodium acid fluoride and hydrogen fluoride; a chloride compound selected from NaCl and $MgCl_2$; and $Cr_2O_3$. Such techniques have proved disadvantageous either because of cost or because they are too disruptive of the substrate or the environment. In the absence of a commercially viable and environmentally clean methodology of removing native oxides from aluminum surfaces, roughening has heretofore been the principal means of bonding thermally spray coatings to cast aluminum surfaces. Such roughening has been carried out by mechanical means such as grit blasting, high pressure water, electric discharge machining or chemical etchants. It would be desirable if a method could be found that eliminated the need for roughening of cast aluminum substrates and yet enables the adherence of metallic coatings thereon.

Fluxes are readily used to remove the surface oxide films from aluminum. This is exemplified by the current commercial practice of brazing two pieces of aluminum alloy sheet metal (usually cold-rolled with a low temperature brazing metal layer) which are joined by first assembling the pieces in a jointed relationship and then flooding the joint area with a flux applied at room temperature. When heated aggressively, the flux melts and strips the surface oxides, thereby allowing the layer to form an interfacial alloy joint with the aluminum, as described in U.S. Pat. No. 4,911,351. The flux composition often has a fluoride or chloride base, as described in U.S. Pat. Nos. 3,667,111 and 5,318,764. Flux made of alkaloid aluminum fluoride or chloride salts have a melting temperature just below the melting temperature of aluminum alloys.

The use of flux has proved very effective when working with rolled aluminum sheet, but the flux will not work with cast aluminum alloys because cast aluminum is porous, non-homogenous, has no clad layer and melts at a temperature that overlaps the melting temperature of the fluxes. This is a significant drawback when (i) the metal that is to be bonded to the cast metal is a thermally sprayed and not the same as the cast metal, and (ii) the metal is applied as hot droplets without the presence of a low melting point braze metal.

Fluxless braze technology, such as presented in WO 97/36709 teaches the use of aluminum chemical etchants NaF, KF or HF in place of flux to improve the fillet forming capability of vacuum braze aluminum alloys. But, this reference required the presence of brazing materials between the articles to be joined.

Non-roughening thermal spray techniques include fluxing of the cast aluminum surface to remove surface oxide prior to thermally spraying coatings is the topic of U.S. Pat. No. 5,723,187. This reference discloses the steps of (1) depositing a flux material (i.e. potassium aluminum fluoride containing up to 50 molar percent other fluoride salts) onto such cast surface which has been cleansed to be substantially free of grease and oils, such deposition providing a dry flux coated surface, the flux being capable of removing oxide on the cast surface and having a melting temperature below that of the cast surface; (2) thermally activating the powder flux in the flux coated surface to melt and dissolve any oxide residing on the cast surface; and (3) concurrently therewith or subsequent to step (2) thermally spraying metallic droplets or particles onto the flux coated surface to form a metallic coating that is metallurgically bonded to the cast surface.

U.S. application Ser. No. 08/829,666 filed on Mar. 31, 1997, "Method of thermally spraying metallic coatings using flux cored wire" now U.S. Pat. No. 5,820,939, teaches a method that simultaneously apply the flux and the metallic coating unto cast aluminum surfaces using cored wire technology. It discloses the use of a cored wire for use in thermal spraying on aluminum alloy substrates having a powder core mixture consisting of (i) metal powder effective to metallurgically bond with the substrate when the metal powder is in molten condition, (ii) a fluxing powder effective to strip aluminum oxides from the substrate surface at appropriate temperatures, (iii) a pliable metal sheath encapsulating the powder mixture and having a composition that is compatible with said bonding metal and (iv) thermally spraying the said cored wire to produce a metallurgically bonded metal coating to the aluminum substrate.

U.S. Pat. No. 5,100,486 teaches a different process to apply flux to remove surface oxide and prepare the metal surface to receive and bond to the metal coating. The method consists of (i) forming a slurry with flux, the metal coating particles and an organic binder, (ii) applying the slurry to the metal substrate, (iii) heating to activate the flux, strip the surface oxide and evaporate the organic binder and (iv) furnace sintering to form a bond between the metal substrate and the metal coating layer.

In all of these non-roughening cases, a solid, commercially available and independent (of the aluminum substrate) flux powder is used to dissolve the substrate surface oxide prior to or concurrently with coating bonding. Advantageously, the current invention teaches the use of the aluminum alloy substrate to grow the flux crystals prior to thermal spraying operation.

While the current invention deposits a coating similar in composition to fluoride fluxes, the inventive double fluoride composition behaves differently than conventional flux. While not wishing to be bound to the following theory, it is believed that the aqueous KF solution reacts with the native aluminum oxide and at proper concentration forms a protective coating layer of a double potassium aluminum fluoride salt which inhibits oxide regrowth.

Therefore, the primary object of this invention is to achieve a method that economically, reliably and instantly bonds thermally sprayed metallic droplets or particles onto an unroughened cast light metal-based substrate without the presence of conventional brazing materials. The method should provide a metallurgical and/or chemical bond between such light metal and thermally sprayed metallic coatings should involve no application of any powdered flux materials as practices by the prior art. The process is also advantageous for manufacturing in that, (1) an aqueous bath replaces the costly fluxing operation, and (2) it eliminates powder handling and thereby more environmental friendly.

SUMMARY OF THE INVENTION

The invention herein that meets the above object is a method that bonds a thermally sprayed coating to a non-roughened cast light metal substantially devoid of grease and oils. The method includes a series of steps including exposing the cast metal surface to an aqueous bath containing potassium fluoride. The bath is capable of chemically reacting with the aluminum substrate to deposit a protective surface coating of a double potassium aluminum fluoride salt that is capable of preventing the regrowth of aluminum oxide on the substrate surface. Subsequently applying, thermally sprayed metallic droplets, or particles onto the coated surface to form a metallic coating that is metallurgically bonded to the aluminum surface.

DETAILED DESCRIPTION OF THE PREFERRED EMBODIMENTS

Figure 1:
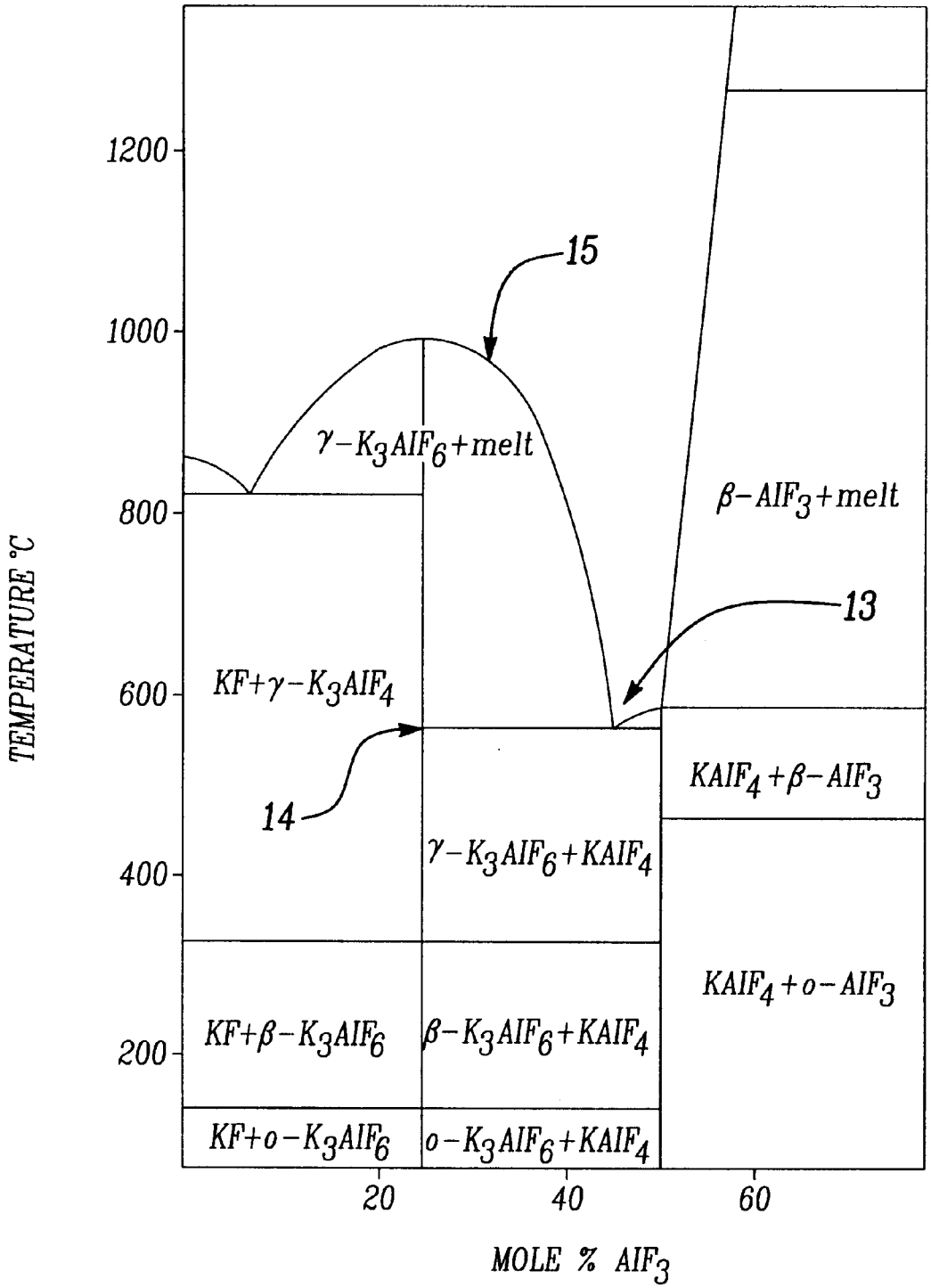
FIG. 1 is a temperature-phase diagram of potassium aluminum fluoride salts as a function of the molar percent of $AlF_3$.
Figure 2:
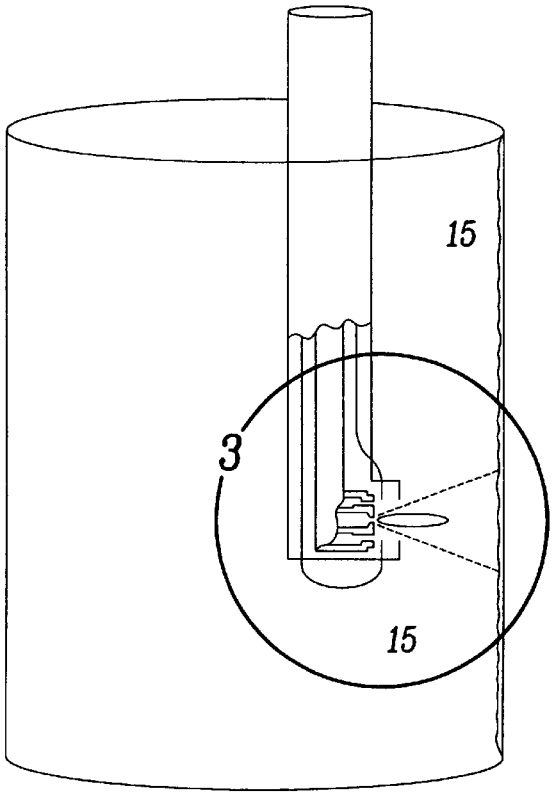
FIG. 2 is a schematic perspective view of a thermal spray apparatus used to apply the metal droplets or particles to the interior surface of a cast aluminum engine block bore surface.

Experience with fluoroaluminum fluxes has usually been with pressed aluminum sheet alloy material having a melting temperature in the range of 640–660° C. This invention is preferably concerned with successful fluxing cast aluminum alloys (such as 319, 356, 380 and 390) that contain Si, Cu, Mn or Fe ingredients in amounts ranging from 0.5–5% (by weight) and thus possess a slightly lower melting temperature (of about 580–600° C.) when compared with the pressed aluminum sheet alloys, such as the 3000 series containing 0.5–1.5% of Mn, Mg and Fe ingredients. The surface roughness of such cast alloys is usually about 1–3 micrometers Ra which is insufficient by itself to provide a mechanical interlock with thermally sprayed coatings thereover.

After the cast component is formed of a light metal, Al, Mg, such as a cast aluminum engine block 10 having a plurality of cylinder bores 11 possessing an interior surface 12 with a roughness of about 0.5–2 micrometers and after such surfaces have been cleansed of any grease or oil, essentially two steps are employed. First, a protective layer of a double potassium aluminum fluoride salt is applied by exposing the aluminum surface to an aqueous solution of KF. The preferred KF solutions range from 2.0–5.0% KF by weight and more preferably, between 2.0–3.0% KF by weight at 120°–150° F. The chemical reaction between that aluminum and the solution forms a surface layer of potassium aluminum fluoride. The layer protects the aluminum surface from the regrowth of aluminum oxide. The coated layer is rinsed with water to remove the KF solution. Lastly, metal droplets or particles are thermally sprayed onto the coated surface to form a metallic coating that is at least metallurgically bonded to the aluminum oxide-free surface.

As shown in FIG. 1, typical aluminum flux is selected preferably to be eutectic 13 comprising a double fluoride salt having the phase formula $K_3AlF_6$+$KAlF_4$. Such eutectic contains $AlF_3$ at about 45 mole percent of the double fluoride salt, with KF being about 55 mole percent. The eutectic has a melting temperature of about 560° C. (along line 14) which is about 40° C. below the melting temperature of the cast alloy of the substrate. If the double fluoride salt has a substantially different molar percentage of $AlF_3$ (thus not being a eutectic) the melting temperature will rapidly rise along line 15 of FIG. 1.

Figure 6:
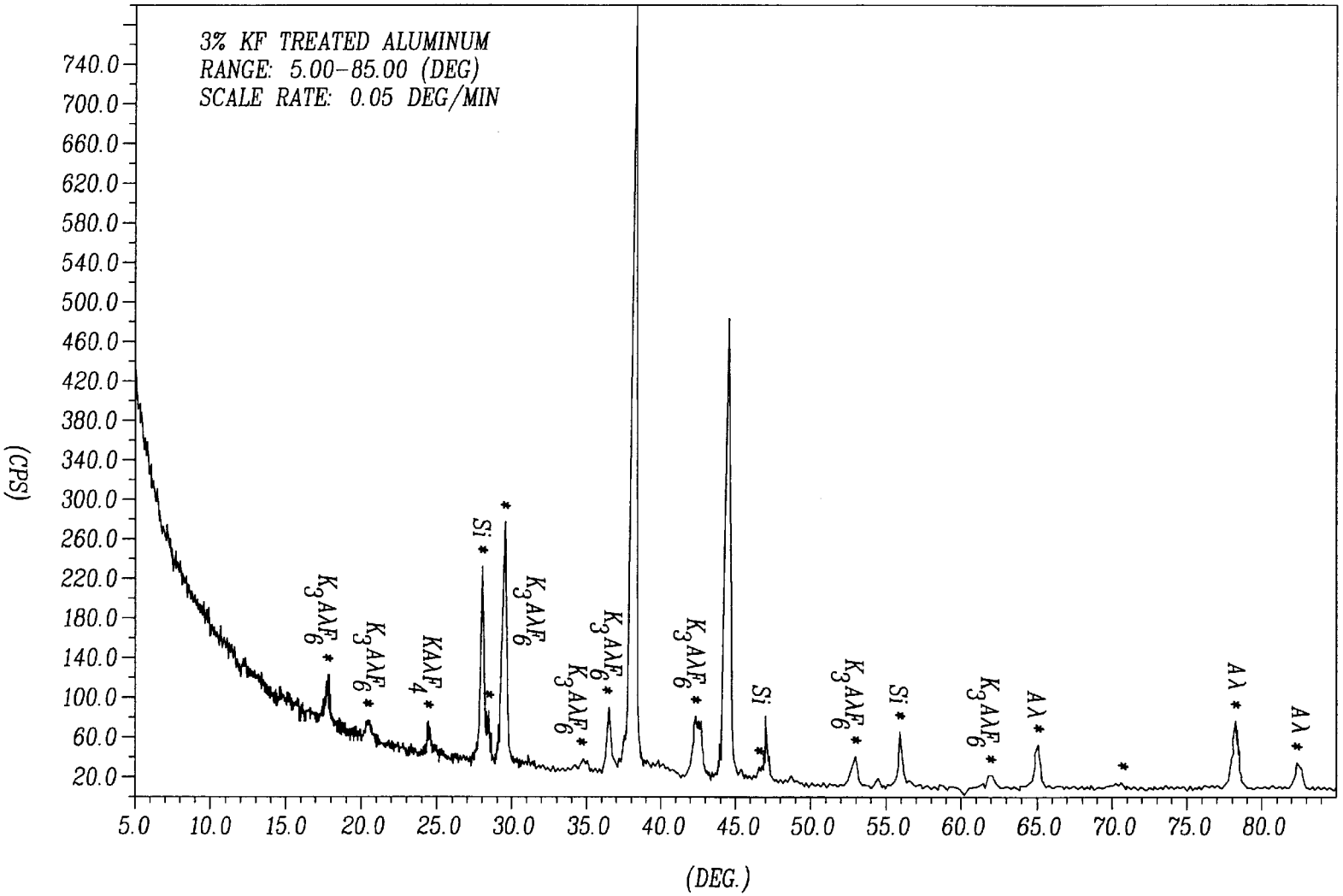
FIG. 6 is an x-ray diffraction spectrum of the surface coating layer of potassium aluminum fluoride.

The current double fluoride salt contains both $K_3AlF_6$ and $KAlF_4$ as seen from FIG. 6, but in a different proportions than that of the eutectic flux. While conventional flux melts at the eutectic temperature of 560° C., the protective coating of the double fluoride salt is still crystalline at 585° C.

Figure 4A:
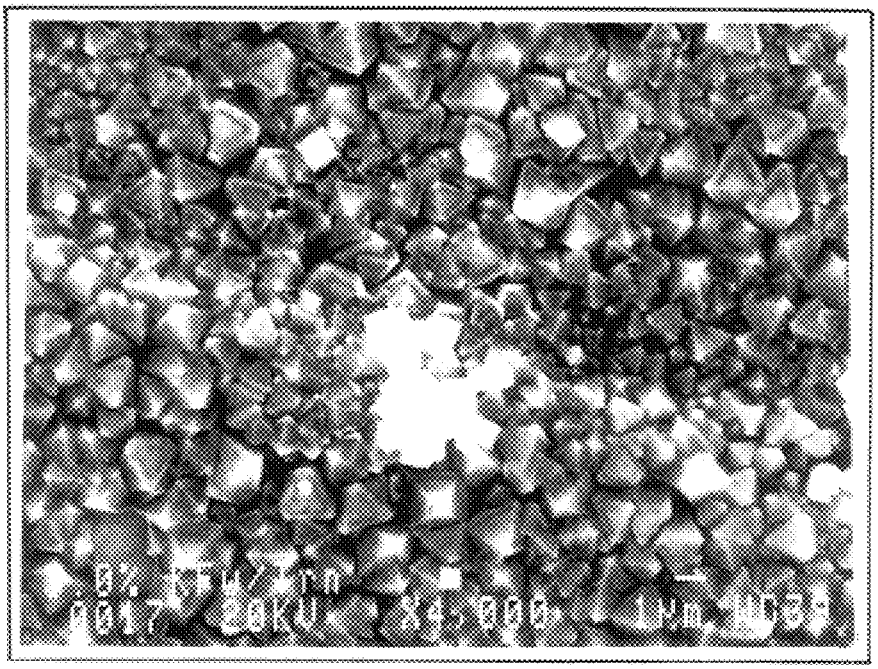
FIG. 4*a* is a scanning electron micrograph of the coated cast aluminum surface using a 3.0% KF solution.
Figure 4B:
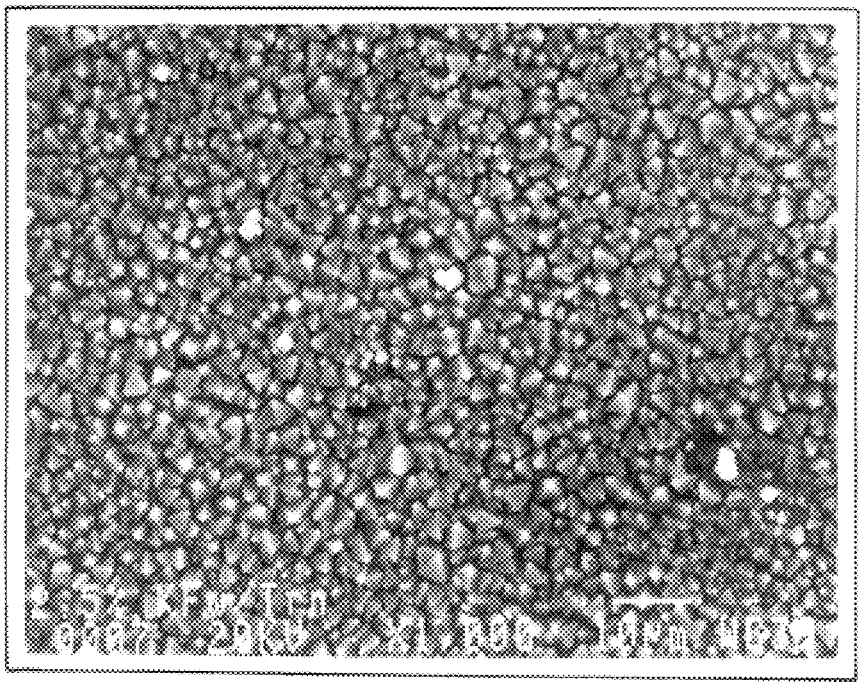
FIG. 4*b* is a scanning electron micrograph of the coated cast aluminum surface using a 2.5% KF solution.

The mechanism of the current invention differs from that of conventional brazing flux. Typical brazing flux is applied as a powder on top of the native aluminum oxide layer. As the flux begins to melt, it dissolves the surface oxide. While not wishing to be bound by the following theory, it is believed that the present invention forms a protective layer in a chemical reaction between the KF and the aluminum. First the KF etches the native oxide layer and then the KF reacts with the oxide free aluminum surface forming the double fluoride salts and protecting the surface from the regrowth of surface oxide. The coating layer protects the aluminum surface and prepares cast metal for thermal spraying. FIGS. 4*a* and 4*b* show scanning electron micrographs for a substrate that has been coated by a KF solution with a concentration of the current invention. The KF forms double fluoride salt crystals that enables the sprayed coating to strongly adhere to the substrate.

Figure 3:
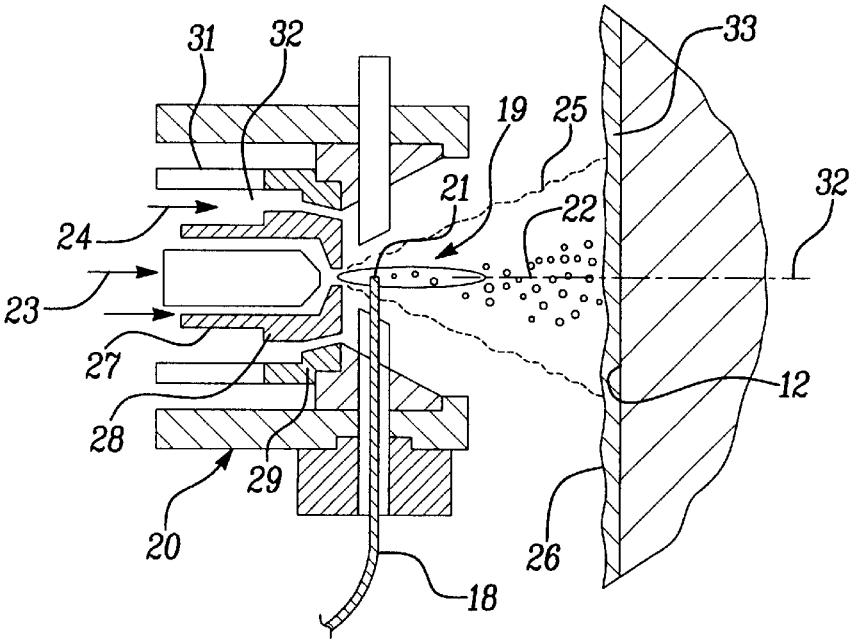
FIG. 3 is a highly enlarged sectional view of a portion of the spray gun and immediate coated surface.

Thermal spraying of metallic droplets or particles can be carried out by use of an apparatus as shown in FIG. 3. A metallic wire feedstock 18 is fed into the plasma or flame 19 of thermal gun 20 such that tip 21 of the feedstock 18 melts and is atomized into droplets 22 by high velocity gas jets 23 and 24. The gas jets project spray 25 onto light metal cylinder bore wall 12 of an engine block and thereby deposit coating 26. The gun 23 may be comprised of inner nozzle 27 which focuses a heat source, such as a flame or plasma plume 19. Plasma plume 19 is generated by stripping electrons from primary gas 23 as it passes between anode 28 and cathode 29 resulting in a highly heated ionic discharge or plume 19. The heat source melts wire tip 21 and resulting droplets 22 are carried by the primary gas 23 at great velocity to the target. A pressurized secondary gas 24 may be used to further control spray pattern 25. Such secondary gas is introduced through channels 30 formed between cathode 29 and housing 31. Secondary gas 24 is directed radially inwardly with respect to axis 32 of plume 19. Wire 18 is melted by connecting the wire to an anode and striking an arc with cathode 29. The resulting coating 26 will be constituted of splat layers or particles 33. While the use of wire feedstock is described in detail herein, powder fed thermal spray devices could be used to produce the same bonding effect.

To further facilitate the metallurgical bond between the oxide free aluminum substrate and the thermally sprayed particles, a bond coat may be initially thermally sprayed thereunto consisting of nickel-aluminum or bronze-aluminum; preferably the bond coat has a particle size of 2.5–8 micrometers which causes the coated surface to have a surface finish of about 6 micrometers Ra. A final top coating of a low carbon alloy steel or preferably a composite of steel and FeO is provided.

If a composite top coating is desired, the wire feedstock is comprised of a low carbon low alloy steel and the secondary gas is controlled to permit oxygen to react with droplets 22 to oxidize and form the selective iron oxide $Fe_xO$. (Wuestite, a hard wear resistant oxide phase having a self lubricating property). The composite coating thus can act very much like cast iron that includes graphite as an inherent self lubricant. The gas component containing the oxygen can vary between 100% air (or oxygen) and 100% inert gas (such as argon or nitrogen) with corresponding degrees of oxygenation of the Fe. The secondary gas flow rate should be in the range of 30–120 standard cubic feet per minute to ensure enveloping all of the droplets with the oxidizing element and to control the exposure of the steel droplets to such gas.

The top coat can be honed to a uniform surface finish of 0.1 to 1.0 $\mu$m and to a thickness of 50–500 micrometers, if desired.

Figure 5:
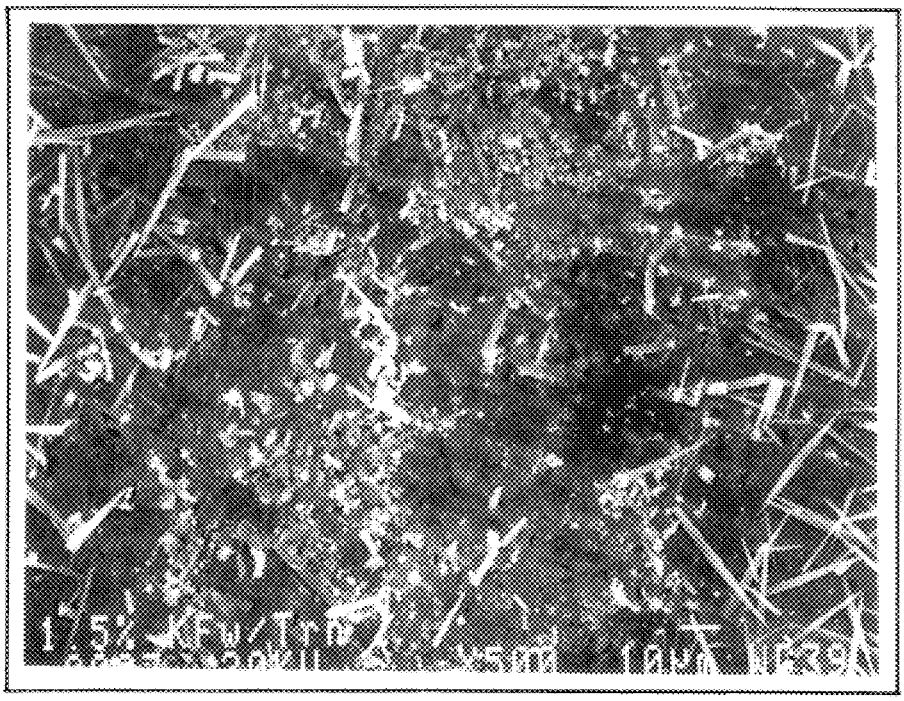
FIG. 5 is a scanning electron micrograph (4000 times magnification) of a coated cast aluminum surface processed at a concentration less than 50 molar percent potassium aluminum fluoride (1.5% KF).

FIG. 5 shows a scanning electron micrograph for a substrate 40 that has been coated by a KF solution with a concentration of less than the current invention. The double fluoride salt crystals are not present and the coating does not adhere.

It was found that practicing the method of this invention reduces the cycle time for the total of the three basic steps to one minute or less. The coatings, when applied in accordance with this invention, were found to adhere to an aluminum substrate (such as 319) with an average interfacial bond strength of 3200–6000 psi.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A method of bonding a thermally sprayed coating to a non-roughened cast light-metal surface substantially devoid of grease and oils, comprising:

(a) exposing said surface to an aqueous bath containing potassium fluoride, said bath reacting with said surface to form a surface coating of potassium aluminum fluoride salt on said surface to provide a protective coated surface; and (b) after step (a), thermally spraying metallic droplets or particles onto said coated surface to form a metallic coating that is at least metallurgically bonded to the light-metal surface.

2. The method as is claim 1, in which potassium aluminum fluoride salt is applied as a solution onto said light metal surface, said solution having a water base.

3. The method as claim 2, in which said solution contains between 2.0–5.0% KF by weight.

4. The method as in claim 2, further comprising after step (a), rinsing said coated surface with water to remove the said solution.

5. The method as in claim 1, in which said potassium aluminum fluoride coating is greater than 50 molar percent potassium aluminum fluoride.

6. A method of bonding a thermally sprayed coating to a non-roughened cast aluminum based surface substantially devoid of grease and oils, comprising:

(a) exposing said surface to an aqueous bath at 120–150° F. containing 2–3% KF by weight, said bath reacting with said surface to form a surface coating of a double potassium-aluminum fluoride salt having the phase formula $K_3AlF_6$+$KAlF_3$ on said surface to provide a protective coated surface;

(b) thermally spraying metallic droplets or particles in one stage, whereby said thermally spraying provides droplets or particles of a composite of low carbon steel and FeO to form a top coating; and (c) honing said top coat to a uniform surface finish of 0.1–1.0 $\mu$m and to a thickness of 50–500 micrometers.

7. The method as in claim 6, in which adhesive bond strength of said thermally sprayed coating to said aluminum based substrate is between 3200–6000 psi.

8. A method of bonding a thermally sprayed coating to a non-roughened cast light-metal surface substantially devoid of grease and oils, comprising:

(a) exposing said surface to an aqueous bath containing potassium fluoride, said bath reacting with said surface to form a surface coating potassium aluminum flouride salt on said surface to provide a protective coated surface, said potassium aluminum fluoride salt being crystalline at 585° C.; and (b) after step (a), thermally spraying metallic droplets or particles onto said coated surface to form a metallic coating that is at least metallurgically bonded to the light-metal surface.

* * * * *

UNITED STATES PATENT AND TRADEMARK OFFICE

CERTIFICATE OF CORRECTION

PATENT NO. : 6,187,388 B1
DATED : February 13, 2001
INVENTOR(S) : Popoola et al.

It is certified that error appears in the above-identified patent and that said Letters Patent is hereby corrected as shown below:

Column 6,
Line 10, "The method as is claim 1" should be -- The method as in claim 1 --.
Line 13, "The method as claim 2" should be -- The method as in claim 2 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*